United States Patent [19]

Ecomard et al.

[11] 4,411,238

[45] Oct. 25, 1983

[54] PUMP-INJECTOR DEVICE FOR AN INTERNAL COMBUSTION ENGINE

[75] Inventors: André Ecomard, Marly le Roi; Louis Briand, Sevres, both of France

[73] Assignee: Institut Francais du Petrole, Rueil-Malmaison, France

[21] Appl. No.: 286,324

[22] Filed: Jul. 24, 1981

[30] Foreign Application Priority Data

Jul. 25, 1980 [FR] France ..... 80 16551

[51] Int. Cl.[3] ..... B05B 9/00

[52] U.S. Cl. ..... 123/501; 123/495; 123/500; 239/125; 239/95

[58] Field of Search ..... 123/500, 501, 502, 495; 239/88, 89, 90, 91, 92, 93, 94, 95, 533.3–533.12, 585, 124, 125; 417/494, 499

[56] References Cited

U.S. PATENT DOCUMENTS

| | | | |
|---|---|---|---|
| 1,157,315 | 10/1915 | Lemp | 239/95 |
| 1,252,254 | 1/1918 | Fisher | 239/95 |
| 2,518,901 | 8/1950 | King | 239/91 |
| 3,131,866 | 5/1964 | Cummins | 239/125 |
| 3,241,768 | 3/1966 | Croft | 239/124 |
| 4,280,659 | 7/1981 | Gaal | 239/124 |

*Primary Examiner*—Charles J. Myhre
*Assistant Examiner*—Carl Stuart Miller
*Attorney, Agent, or Firm*—Millen & White

[57] ABSTRACT

This device comprises a body provided with a bore in which a plunger is slidably mounted, this plunger is movable between a lower position in which it obturates injection nozzles provided through the bottom of the bore, and an upper position where it is spaced from the bottom. Metering means comprise a feed groove provided in the piston wall and opening on the tapered end thereof, this groove having an upper edge inclined to the piston axis. This upper edge co-operates with a fuel inlet port. A similar groove is provided in the piston wall, this groove having an inclined upper edge co-operating with a fuel discharge port. Fuel metering is achieved by rotation of the plunger about its axis.

6 Claims, 23 Drawing Figures

PUMP-INJECTOR DEVICE FOR AN INTERNAL COMBUSTION ENGINE

BACKGROUND OF THE INVENTION

The present invention relates to a pump-injector device providing both fuel metering and injection in an internal combustion engine.

There is already known from German Patent specification No. 2,719,228 a device for introducing into an engine a pressurized air-fuel mixture.

From British Pat. No. 447,057 is also known a fuel metering and pumping device which requires the provision of a check-valve between the pumping element and the injection orifice, and U.S. Pat. No. 2,635,590 discloses a device comprising a piston or needle displaceable in a bore which communicates with the injection orifices, fuel metering and injection being achieved during opposed displacements of the piston.

Such prior devices do not generally provide for an accurate timing of the beginning or end of the injection.

There is also known, in particular, from French Pat. Nos. 1,435,259 and 2,027,645, and from the paper "Simulation of the Cummins Diesel Injection System" of Andrew Rosselli and Pat Bagdley presented to the Society of Automotive Engineers (No. 710,570), a fuel injector comprising an injector body having an axial bore whose bottom is traversed by at least one fuel injection orifice or nozzle. A duct supplying fuel under pressure opens in the bottom of this bore. A plunger or needle is slidable in this bore between a first position in which this plunger is spaced from the bottom of the bore, and a second position which is reached at the end of the injection and in which the lower end of the plunger obturates the injection orifices or nozzles.

The displacements of the piston are controlled by an assembly of cam, push rods, rocker arm and return spring.

With such an injector, the injected fuel charge is adjusted by metering the fuel quantity admitted into the injector bore through the fuel supply or inlet duct. Depending on the fuel quantity or charge to be injected, the bore is more or less filled with fuel at the moment where the plunger begins its stroke for fuel expelling, being displaced from its first to its second position. To this end, the fuel inlet orifice is fed with fuel under a pressure varying in relation with the position of the gas pedal and the engine running speed. Thus, the fuel quantity admitted into the bore varies in relation with the inlet pressure and with the duration of the fuel metering period which is inversely proportional to the engine running speed, hence the designation "P-T (Pressure Time) system".

The drawbacks of such a system are to be found, on the one hand, in the difficulty of balancing the flow rates from the different injectors in a multi-cylinder engine, taking into account the importance of a proper calibration of the fuel inlet orifice of each injector, and, on the other hand, in the method itself of regulating the fuel injection, i.e. an automatic control based on the fuel supply pressure.

SUMMARY OF THE INVENTION

The problem of fuel metering is solved, according to the invention, by providing a fuel pump and injector device for an internal combustion engine, comprising a body provided with a bore whose bottom communicates with at least one fuel injection orifice or nozzle, at least one fuel inlet duct opening in said bore through an inlet port, this duct being connected with a source of pressurized fuel, a piston or plunger slidably mounted in said bore between two end positions, the lower end of the piston obturating the injection orifice in its first position and being spaced from the bore bottom in its second position, and metering means for injecting a determined fuel quantity, said metering means comprising:

(a) at least one feed groove provided in the piston wall and opening at the end thereof, located on the side of the injection orifice, this groove periodically communicating with the fuel inlet port during the displacements of the piston and being limited by at least one edge inclined with respect to the piston axis, with the relative position of this inclined edge and the fuel inlet port controlling the fuel injection, and (b) means for adjusting the angular interval between the fuel inlet port and said inclined edge of the groove.

According to a first alternative embodiment, the metering means further comprises:

(a) a fuel outlet or discharge duct opening in the bore through a fuel discharge port, and (b) at least an outlet groove provided in the piston wall and opening at the end thereof located on the side of the injection orifice, this outlet groove periodically communicating with said fuel discharge port during at least a fraction of the time of communication of the inlet port with the feed groove, said discharge groove being limited by an edge inclined to the piston axis, fuel injection occurring when the piston is brought close to its first position and the inlet and outlet ports are simultaneously closed.

According to a second alternative embodiment which can be combined with any one of the preceding embodiments, the metering means additionally comprise:

(a) a second inlet duct opening in the bore through a second inlet port, this second inlet duct being fed with pressurized fuel from said fuel source through a non-return valve, and (b) a second inlet duct provided in the piston wall and opening at the end thereof located on the side of the injection orifice, said second inlet groove permanently communicating with said second inlet port.

BRIEF DESCRIPTION OF THE DRAWINGS

The invention will be readily understood and all its advantages made apparent from the following description of particular embodiments illustrated in the accompanying drawings wherein.

DETAILED DISCUSSION OF THE INVENTION

Figure 1:
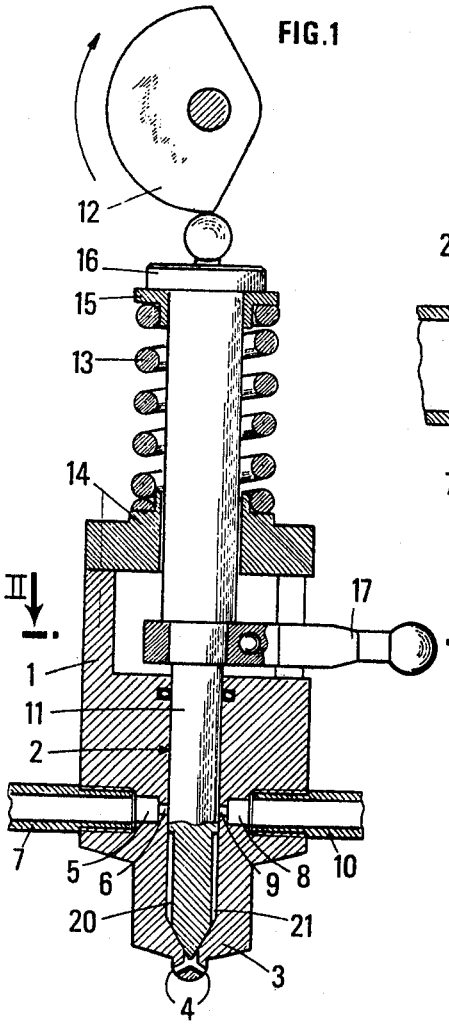
FIG. 1 is a diagrammatic cross-section of the device according to the invention in the position of the end of injection, FIG. 1A partially shows the same device with the plunger spaced from the injection orifices.

The pump-injector device diagrammatically illustrated in cross-section in FIG. 1 comprises a body 1 in which is provided a bore 2. The lower end 3 of the bore is traversed by at least one injection orifice or nozzle 4 which communicates with the bore 2.

The body 1 is also provided with an inlet duct 5 which opens in the bore 2 through an inlet port 6. The duct 5 is connected through a pipe 7 to a source of pressurized fluid (not shown).

An outlet or discharge duct 8, also provided in the body 1, opens in the bore 2 through an outlet or discharge port 9. This duct 8 is connected with the fuel supply source through a return pipe 10.

A piston or plunger 11, which may be of the needle type, is slidably mounted in the bore 2. A profiled cam 12, driven in rotation, displaces the piston 11 against the action of return means, such as a spring 13 which bears, on the one hand, on a cover plate 14 secured to the body 1, and, on the other hand, on a disc 15 which is in abutment against a shoulder 16 of the piston 11.

Figure 1A:
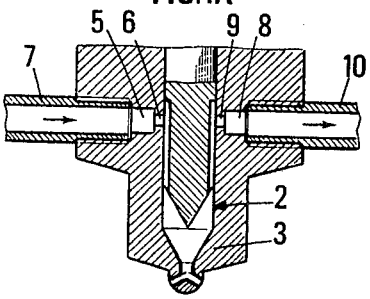

The piston 11 is thus axially displaceable in the bore 2 between a first position (FIG. 1) where it is pressed against the bottom of the bore 2 and cuts off any communication between this bore and the injection nozzles 4, and a second position (FIG. 1A) where this piston is spaced from the bottom of the bore 2.

Figure 2:
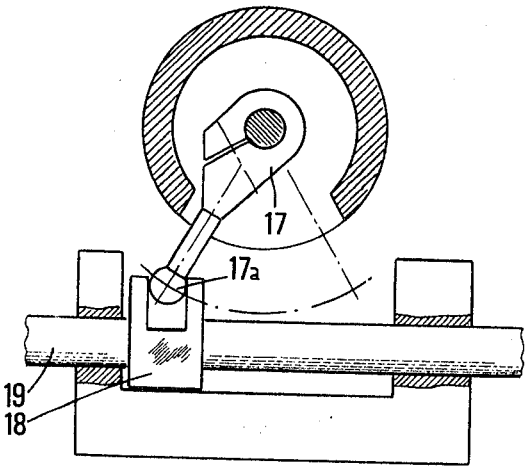
FIG. 2 is a cross-sectional view along line II—II of FIG. 1.

The piston 11 can be rotated about its axis through a rod 17 having one end 17*a* (FIG. 2) driven by a stirrup 18 connected to a linkage 19 which is directly or indirectly actuated by the gas pedal of the engine. The stirrup 18 is elongated in a direction parallel to the axis of the bore 2 to permit axial displacement of the piston 11.

Figure 3:
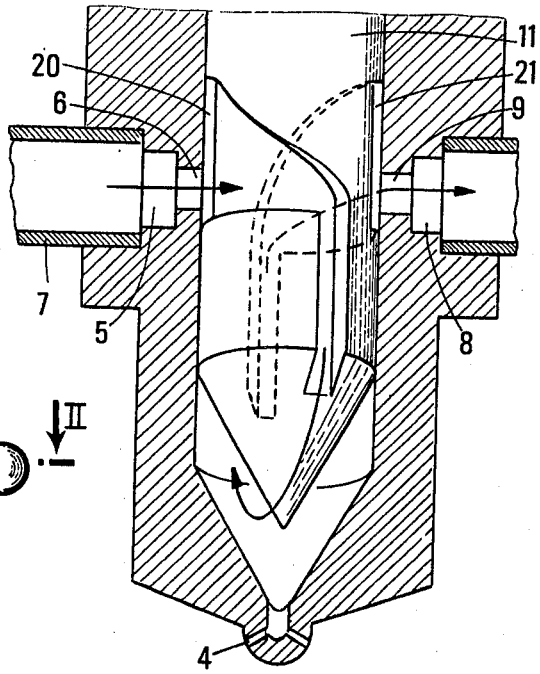
FIG. 3 is a perspective view of the end of the piston positioned in the body of the device.

The piston 11 is provided with a feed groove 20 and a discharge or outlet groove 21 which are shown in perspective in FIG. 3, these grooves opening at the end of the piston 11 located on the side of the injection orifices or nozzles 4, i.e. on the lateral wall of the tapered end of the piston 11.

Figure 4:
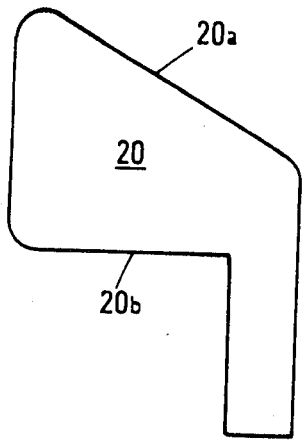
FIG. 4 is a developed view of the grooves.

In the embodiment illustrated in FIG. 4 which shows a developed view of one of these grooves, this groove has an edge 20*a* inclined to the axis of the plunger 11 and an edge 20*b* such that, in the second position (FIG. 1A) of the plunger, the grooves 20 and 21 communicate with the ports 6 and 9 respectively.

The operation of this pump-injector device is diagrammatically illustrated in FIGS. 5 to 9, assuming that the angular positioning $\theta$ of the piston 11, which is controlled by the rod 17 as above indicated, remains constant throughout a working cycle, and further assuming that the pipe 10 is connected with the fuel source through a fuel return circuit, and that the relative positions of the ports 6 and 9 with respect to the grooves 20 and 21 are the same.

Figure 5A:
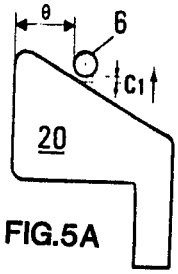
FIGS. 5A–B to 9A–B show in developed views the positions of the inlet and discharge ports relative to the feed and discharge grooves, during a working cycle of the device.
Figure 5B:
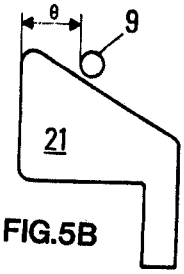

It is also assumed that the piston 11 is in its first position shown in FIG. 1. Under these conditions, as illustrated in FIGS. 5, the grooves 20 and 21 do not communicate with the ports 6 and 19.

Figure 6A:
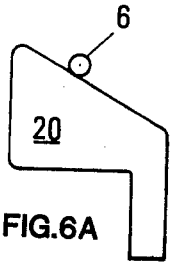
Figure 6B:
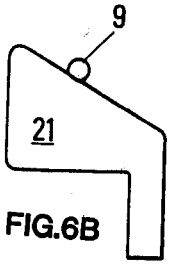
Figure 7A:
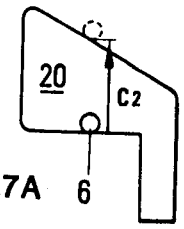
Figure 7B:
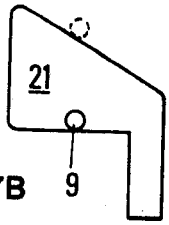
Figure 8A:
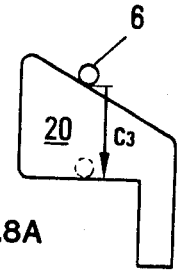
Figure 8B:
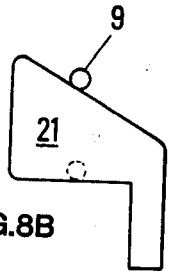
Figure 9A:
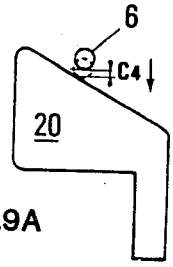
Figure 9B:
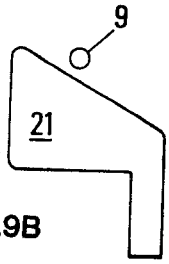

A rotation of the cam 12 in the direction indicated by the arrow in FIG. 1 and the action of the spring 13 cause an axial displacement of the piston 11. After a stroke $C_1$ the ports 6 and 9 register with the inclined edges 20*a* and 21*a* of the grooves 20 and 21 (FIGS. 6). During a subsequent displacement $C_2$ of the piston 11, the ports 6 and 9 communicate with the grooves 20 and 21. The fuel under pressure enters the groove 20 through port 6, then flows through the bore 2, into the groove 21 and escapes therefrom through port 9, as shown by the arrows in FIG. 3. When the grooves 20 and 21 have reached the second end position (FIGS. 1A and 7), the movement of the piston 11 is reversed. Under the action of the cam 12 it effects a stroke $C_3$ (FIGS. 8) at the end of which the ports 6 and 9 are closed by the piston and no longer communicate with the grooves 20 and 21. The fuel injection through the nozzles 4 substantially begins at this time. This injection occurs throughout the stroke $C_4$ of the piston 11 (FIGS. 9) which then moves back to its first position (FIG. 5).

The above description shows that the quantity of fuel injected into the cylinders of the engine depends on the relative angular positioning $\theta$ of the grooves 20 and 21 and of the ports 6 and 9.

Modifications can be made without however, departing from the scope of the present invention.

It will be, for example, possible to connect the pipes 7 and 10 in parallel to the source of fuel under pressure or also to omit the duct 8 and the corresponding groove 9, the fuel being supplied solely through the pipe 7.

Figure 10A:
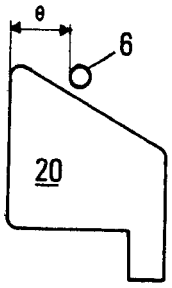
FIGS. 10A-B to 13A-C illustrate alternative embodiments.
Figure 10B:
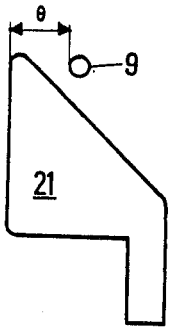

It will be also possible to provide the edges 20*a* and 21*a* of the groove 20 and 21 with different inclinations, as shown in developed view in FIG. 10.

Figure 11A:
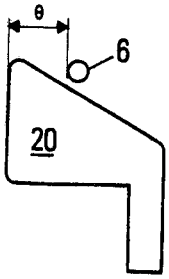
Figure 11B:
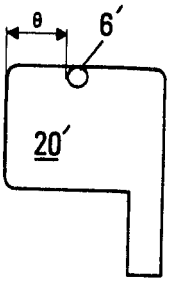
Figure 12:
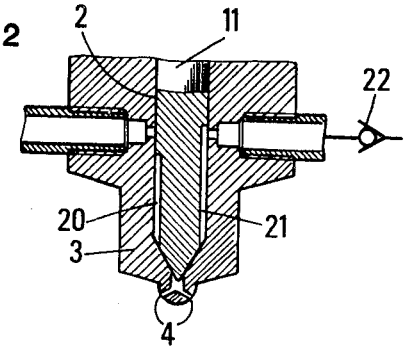

According to an alternative embodiment diagrammatically shown in FIGS. 11 and 12, the port 9 and the groove 21 are replaced by a second inlet port 6′ connected with the fluid source through a non-return valve 22 (FIG. 12), and by a groove 20′ so designed as to permanently remain in communication with port 6′. Thus, fuel filling of the bore 2 begins as soon as the piston 11 is moved away from its first position shown in FIG. 12.

Figure 13A:
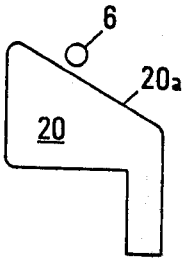
Figure 13B:
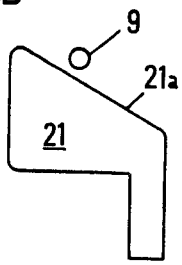
Figure 13C:
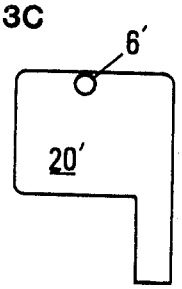

A second alternative embodiment diagrammatically illustrated in FIG. 13 showing a developed view of the piston, combines the embodiments of FIGS. 1 and 11, i.e. the device is provided with two inlet ports 6 and 6′ corresponding to two feed grooves 20 and 20′, the second groove 20′ remaining in permanent communication with the port 6′ which is fed with fuel through a non-return valve, and an outlet port 9 periodically communicating with the discharge groove 21.

In the above-described embodiments which make use of a plurality of ports opening in the bore 2 and of corresponding grooves provided in the piston 11, such ports may be located at different levels of the device.

In the embodiments comprising two inlet ports, these ports may be connected to a single fuel source or to two sources of different fuels respectively.

What is claimed is:

1. A pump injector device for internal combustion engine, comprising a body provided with a bore whose bottom communicates with at least one fuel injection orifice or nozzle, at least one fuel inlet duct opening in the bore through an inlet port, said duct being connected with a source of pressurized fuel, a piston or plunger slidably mounted in said bore between a first end position where said piston obturates said injection nozzle and a second end position where said piston is spaced from said bottom of said bore, and fuel metering means for injecting a determined fuel quantity, said fuel metering means comprising:

(a) at least one feed groove provided in the piston wall and opening at the end thereof located closest to the injection orifice, this groove periodically communicating with said fuel inlet port during the displacement of the piston and forming at least one edge inclined to the piston axis and whose position relative to said inlet port controls the fuel injection, and (b) means for adjusting the angular distance separating said inlet port and said inclined edge of said groove.

2. A device according to claim 1, wherein said means for adjusting said angular distance are operative to rotate the piston about its axis in relation with the position of a gas pedal of said internal combustion engine.

3. A device according to claim 1, wherein said fuel metering means comprises:

(a) a fuel outlet or discharge duct opening in the bore through a fuel discharge port, (b) at least one discharge groove provided in the piston wall and opening at the end of said piston located closest to said fuel injection orifice, said discharge groove periodically communicating with said outlet port during at least a fraction of the time of communication of said inlet port with said feed groove, said discharge groove being limited by an edge inclined to the piston axis, the fuel injection occurring when said inlet and outlet ports are simultaneously closed by the piston wall.

4. A device according to claim 3, wherein said inclined edges of said feed groove and discharge groove have the same inclination relative to the piston axis, and wherein the positions of the inlet port and of the discharge port with respect to said feed groove and to said discharge groove respectively are identical.

5. A device according to claim 4, wherein said inclined edges of said feed groove and discharge groove have different inclinations with respect to the piston axis.

6. A device according to claim 1 or 3, wherein said fuel metering means comprise:

(a) a second inlet duct opening in said bore through a second inlet port, said second inlet duct being connected with said source of pressurized fluid through a non-return valve, and (b) a second feed groove provided in the piston wall and opening at the end of said piston located on the side of said injection nozzle, and said second feed groove being in permanent communication with said second inlet port.

* * * * *